United States Patent [19]

Lackey

[11] 4,195,406

[45] Apr. 1, 1980

[54] SCRIBE KNIFE

[76] Inventor: Gillam B. Lackey, 406 N. Harrison, Aurora, Ill. 60506

[21] Appl. No.: 946,043

[22] Filed: Sep. 26, 1978

[51] Int. Cl.[2] ..... B26B 3/00

[52] U.S. Cl. ..... 30/164.9; 30/293; 30/294

[58] Field of Search ..... 30/164.9, 294, 293

[56] References Cited

U.S. PATENT DOCUMENTS

| | | | |
|---|---|---|---|
| 2,413,544 | 12/1946 | Carpenter | 30/293 |
| 2,557,699 | 6/1951 | Silver | 30/293 |
| 2,778,423 | 1/1957 | Zimmerman | 30/293 |
| 2,986,814 | 6/1961 | Brinkman | 30/293 |
| 3,934,341 | 1/1976 | Carlson | 30/293 |

*Primary Examiner*—Othell M. Simpson
*Assistant Examiner*—J. T. Zatarga
*Attorney, Agent, or Firm*—Clarence A. O'Brien; Harvey B. Jacobson

[57] ABSTRACT

An elongated tubular body of square cross section is provided and an endwise outwardly tapering nose is secured in one end of the tubular member. One longitudinal side of the tubular member includes a narrow closed ended slot formed therein and extending longitudinally therealong. The opposite longitudinal side of the tubular member has a wide longitudinal slot formed therein and the wide slot opens through the end of the tubular member remote from the nose. A support block is guidingly and slidingly received within the tubular member and a headed set screw is threadedly engaged in the support block and extends through the narrow groove. A V-shaped cutting blade is carried by the side of the support block adjacent the nose and is disposed in a plane transverse to the longitudinal center line of the tubular member and the apex of the cutting blade projects through the wide slot.

2 Claims, 6 Drawing Figures

SCRIBE KNIFE

BACKGROUND OF THE INVENTION

Various forms of scribes have been heretofore provided for the purpose of marking soft flooring. However, some forms of scribes presently used have a tendency to tear the ornamental surface of soft flooring as opposed to cutting the ornamental surface cleanly. Accordingly, a need exists for a scribe knife which may be utilized to properly scribe and cut soft flooring without tearing the ornamental surface thereof. Examples of previous known forms of scribe tools including some of the general structural and operational features of the instant invention are disclosed in U.S. Pat. Nos. 1,895,754, 1,993,132, 2,581,179, 2,654,953, 2,729,895 and 3,286,351.

BRIEF DESCRIPTION OF THE INVENTION

The scribe knife of the instant invention is specifically designed for use in conjunction with linoleum and other similar types of soft flooring. The scribe knife functions in a manner making an easy task of properly scribing the soft flooring being laid and it accomplishes the scribing operation without tearing the ornamental surface of the soft flooring.

It is proposed that the scribe knife of the instant invention will be constructed of two different sizes. A short size of approximately 9 inches in length and a long size of approximately 18 inches in length have been found to be most convenient to use. The 9-inch size is useful in small areas and the ~-inch size is useful in the scribing of cabinets that are offset.

The main object of this invention is to provide an improved form of scribe knife that may be utilized to make a clean cut in soft flooring substantially fully through the thickness of the flooring.

Yet another object of this invention is to provide a scribe knife of such construction enabling it to be readily used in various environments.

Still another important object of this invention is to provide a scribe knife capable of being used in conjunction with various different forms of soft flooring.

A final object of this invention to be specifically enumerated herein is to provide a scribe knife in accordance with the preceding objects and which will conform to conventional forms of manufacture, be of simple construction and easy to use so as to provide a device which will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
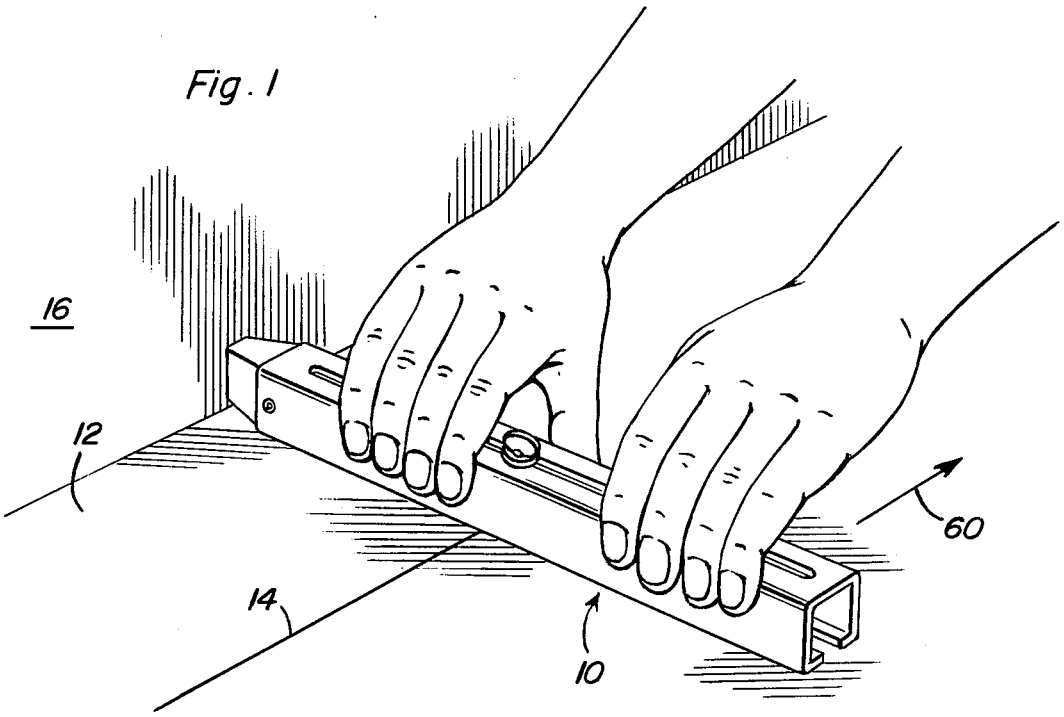
FIG. 1 is a perspective view of the scribe knife of the instant invention in operation scribing one marginal portion of a soft flooring section.
Figure 2:
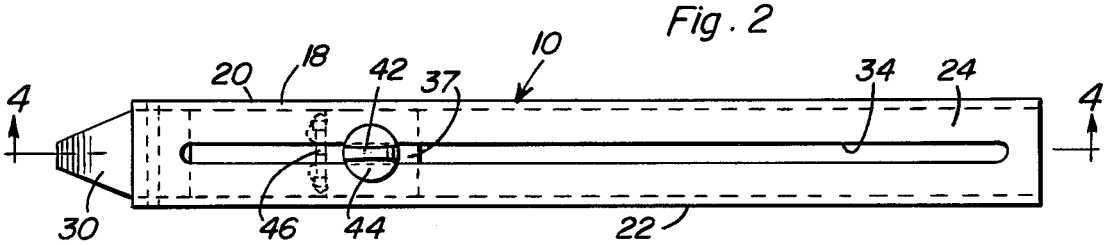
FIG. 2 is a top plan view of the scribe knife.
Figure 3:
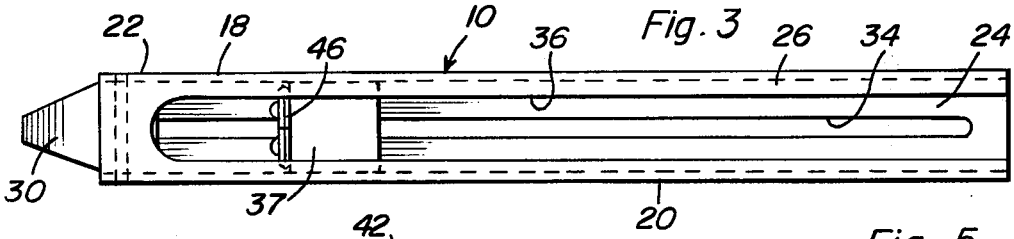
FIG. 3 is a bottom plan view of the scribe knife.

Referring now more specifically to the drawings, the numeral 10 generally dsignates a scribe knife constructed in accordance with the present invention and which is illustrated in FIG. 1 in the process of scribing (cutting) a section of soft floor covering 12 along one marginal portion thereof as at 14 extending along and spaced outwardly from a wall 16.

The scribe knife 10 comprises a tubular body 18 of square cross-sectional shape and the body 18 includes opposite longitudinal side walls 20 and 22 and top and bottom longitudinal walls 24 and 26. An outwardly tapering nose 30 is snugly received and secured within one end of the tubular body 18 by means of a transverse fastener 32 and the top wall 24 of the body 18 has a narrow longitudinal slot 34 formed therein while the bottom wall 26 of the body 18 has a wide longitudinal slot 36 formed therein, the slots 34 and 36 being vertically registered. The opposite ends of the slot 34 terminate inwardly of the opposite end of the tubular body 18 and the end of the wide slot 36 terminates inwardly of the end of the tubular body 18 in which the nose 30 is secured, but opens endwise outwardly through the end of the tubular body 18 remote from the nose 30.

The square support block 37 is snugly and slidably received within the tubular body 18 and includes an upwardly opening centrally disposed threaded blind bore 38 formed therein. The lower threaded shank portion 40 of a thumb-type clamp screw 42 including enlarged head 44 is threadedly engaged in the bore 38 and the head 44 is engageable with the upper surface of the top wall 18 on opposite sides of the slot 34, whereby those portions of the top wall 18 on opposite sides of the slot 34 and beneath the head 44 may be clamped between the head 44 and the block 37. In this manner, the block 37 may be releasably secured in adjusted shifted position along the tubular body 18.

The forward side of the block 37 has a V-shaped cutting blade 46 secured thereto by means of threaded fasteners 48 and the blade 46 includes oppositely upwardly and outwardly inclined cutting edges 50 and 52 converging downwardly to a center apex 54 disposed below the bottom wall 26. The block 37 includes a pair of outwardly projecting abutment pins 56 which extend outwardly from the front side of the block 37 and function to properly position the blade 46 relative to the block 37 for securement thereto by means of the fasteners 48.

Figure 4:
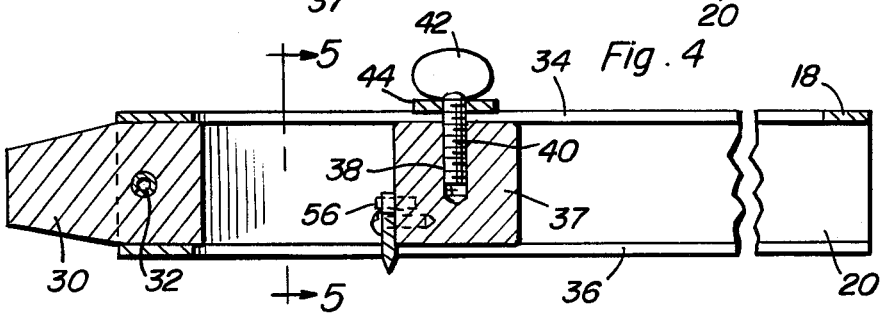
FIG. 4 is a fragmentary enlarged longitudinal vertical sectional view taken substantially upon the plane indicated by the section line 4—4 of Fiqure 2.
Figure 5:
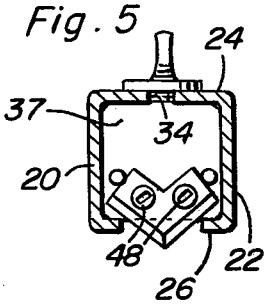
FIG. 5 is a transverse sectional view taken substantially upon the plane indicated by the sectional line 5—5 of Figure 4.
Figure 6:
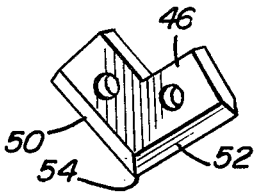
FIG. 6 is an enlarged perspective view of the V-shaped blade of the scribe knife.

It is believed that it will be readily apparent from FIG. 4 of the drawings that the clamp screw 42 may be loosened in order that the block 37 may be shifted to the desired position along the body 18. Thereafter, the clamp screw 42 may be tightened in order to releasably retain the block 37 in adjusted position.

Then, if it is desired to scribe the soft flooring section 12, the scribe 10 may be positioned in the manner illustrated in FIG. 1 of the drawings with the nose 30 thereof slidingly engaged with the wall 16 and the body 18 extending outwardly from the wall 16. Of course, the blade 46 will be engaged with the soft flooring section 12 and will scribe (cut) the soft flooring 12 cleanly as the scribe knife 10 is moved in the direction of the arrow 60 in FIG. 1.

The nose 30 includes an outer portion which is truncated pyramidal in shape in order that it will not scratch or mar the wall 16 and also in a manner which will enable it to follow curves and corners. Further, the support block 37 is slidably received within the tubular body 18 and includes beveled corner edges extending longitudinally of the body 18 for ease in longitudinal shifting relative thereto when the clamp screw 42 is loosened and the V-shaped blade 46 enables the soft flooring 12 to be easily cut during movement of the scribe knife 10 in opposite directions.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scribe knife comprising an elongated tubular body including an endwise outwardly projecting contour tracing nose on one end and including a lower longitudinal side for overlying and sliding over soft flooring materials, the other end of said body being open and said lower longitudinal side having a wide longitudinally extending slot formed therein opening through the end of said lower side remote from said nose at said other end of said body, a support block slidably supported within said body for guided movement therealong and displaceable outwardly from said body through the open other end thereof, said block and body including coacting means operative to releasably retain said block in adjusted shifted position within said body, and a V-shaped blade removably supported from, and in overlying relation to, the end of said block adjacent said nose and including an apex which projects downwardly, slightly, through said slot and is receivable through the open end of said slot, said blade including upwardly divergent straight cutting edges converging downwardly toward an apex and disposed in a plane normal to the longitudinal center line of said tubular body, said tubular body including an upper longitudinal side having a narrow longitudinally extending slot formed therein, a clamp screw extending and slidable through said narrow slot and removably threaded into said block for releasably clamping the portion of said upper longitudinal side adjacent said clamp screw between the latter and the underlying portions of said block, the opposite ends of said narrow slot being closed to define limits of shifting of said block within said tubular body by engagement of said clamp screw with the portions of said upper side defining the closed ends of said narrow slot, said tubular body being substantially rectangular in cross section and said block being of a similar cross section, the corner edges of said block extending longitudinally of said body being beveled, said slots being vertically registered, whereby the apex of said blade may be viewed, from above said body, through said slots.

2. The combination of claim 1 wherein at least the outer portion of said nose is shaped in the form of a truncated pyramid.

* * * * *